US006471432B1

(12) United States Patent
Kremer

(10) Patent No.: US 6,471,432 B1
(45) Date of Patent: Oct. 29, 2002

(54) MARKER PEN

(75) Inventor: Scott E. Kremer, Northville, MI (US)

(73) Assignee: The Detroit Edison Company, Detroit, MI (US)

( * ) Notice: Subject to any disclaimer, the term of this patent is extended or adjusted under 35 U.S.C. 154(b) by 0 days.

(21) Appl. No.: 10/053,000

(22) Filed: Jan. 18, 2002

(51) Int. Cl.[7] ..... A46B 11/00
(52) U.S. Cl. ..... 401/48; 401/195
(58) Field of Search ..... 401/48, 131, 6, 401/52, 195, 216

(56) References Cited

U.S. PATENT DOCUMENTS 3,972,628 A * 8/1976 Stevers ..... 401/48
4,149,812 A * 4/1979 Huffman, Jr. ..... 401/6
4,906,119 A * 3/1990 Hartford et al. ..... 401/48
5,037,224 A * 8/1991 Wright ..... 401/48
5,172,994 A * 12/1992 Brown ..... 401/216

* cited by examiner

*Primary Examiner*—David J. Walczak
(74) *Attorney, Agent, or Firm*—Reising, Ethington, Barnes, Kisselle, Learman & McCulloch, P.C.

(57) ABSTRACT

A marker pen has a marker tip at one end and a reservoir for marker fluid adjacent the other end. The pen is pivoted between the marker tip and the reservoir to one end of a support arm for pivotal movement from a position of use to a stored position. In the position of use, the support arm rests between the thumb and index finger of the user and the reservoir extends upwardly above the marker tip. In the stored position, the reservoir extends alongside the support arm.

2 Claims, 1 Drawing Sheet

MARKER PEN

This invention relates generally to writing and/or marking implements and more particularly to a fluid marker pen.

BACKGROUND OF THE INVENTION

Fluid marker pens typically have a reservoir for storing marker fluid. These pens are very popular and perform satisfactorily when the marker fluid is flowing. However, the marker fluid does not always flow. Usually the pen has to be shaken initially to get the flow of fluid started, and often the pen has to be shaken again and again as use continues. This is true particularly when the pen is held so that the reservoir is below the marker tip, as it usually is when writing or marking on a vertical surface of a white or black board. What is needed is a pen that ensures a continuous flow of fluid to the marker tip at all times.

SUMMARY OF THE INVENTION

In accordance with the present invention, the marker pen is attached to a support in a manner such that when the pen and support are held in the hand, the reservoir is above the marker tip, ensuring a flow of marking fluid by gravity even when writing on a vertical surface.

The support is preferably in the form of an arm having one end pivoted to the pen for movement of the pen from a position of use to a stored position. In the position of use, the support arm rests between the thumb and the index finger of the user and the reservoir extends upwardly above the marker tip. In the stored position, the reservoir extends alongside the support arm.

Further in accordance with the invention, the pen is releasably locked selectively in the position of use and in the stored position. This may be accomplished by a detent on the arm engagable in recesses formed in the pen.

One object of the invention is to provide a marker pen assembly having the foregoing features and capabilities.

Another object is to provide a marker pen assembly which is composed of a relatively few simple parts, is rugged and durable in use, and is capable of being inexpensively manufactured.

These and other objects, features and advantages of the invention will become more apparent as the following description proceeds, especially when considered with the accompanying drawings.

DETAILED DESCRIPTION OF THE PREFERRED EMBODIMENT

Figure 1:
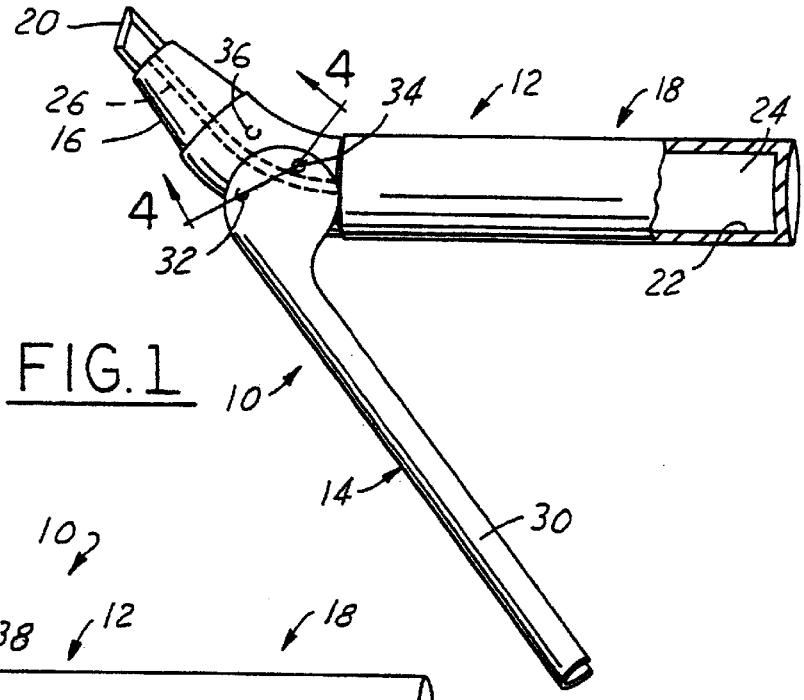
FIG. 1 is a perspective view of a marker pen assembly constructed in accordance with the invention, showing the pen in a position of use relative to the support arm.

Referring now more particularly to the drawings, a marker pen assembly 10 is shown having an elongated marker pen 12 and a support 14.

The marker pen 12 has an inner end portion 16 and an elongated, cylindrical, barrel-shaped outer end portion 18.

The inner end portion 16 has a marker tip 20 at the inner end. The outer end portion 18 defines therein a chamber 22 providing a reservoir 24 for marker fluid. An internal passage 26 in the marker pen 12 extends from the reservoir 24 to the marker tip 20 for the flow of marker fluid from the reservoir to the marker tip.

The support 14 is in the form of an elongated arm 30 preferably made of a flexible plastic material. The arm 30 is in the shape of a concavo-convex, semi-cylindrical trough. Aligned transverse pivots 32 on one end of the arm 30 extend into sockets 33 in the marker pen 12 to connect the marker pen to one end of the arm 30 at a point between the inner and outer end portions 16 and 18 of the marker pen for pivotal movement of the marker pen from a position of use shown in FIG. 1 to a position for storage shown in FIG. 2. In the position for storage, the barrel-shaped outer end portion 18 extends alongside the arm 30 in parallel relationship therewith and rests or fits down into the concave side of the arm 30.

The marker pen 12 is releasably locked selectively in the position of use and in the position for storage by transversely aligned detents 34 secured to the arm 30 and transversely aligned recesses 36 and 38 in the body of the marker pen 12. The detents 34 and recesses 36 and 38 are on an arc centered on the pivots 32. The detents 34 are engagable in the recesses 38 to releasably lock the marker pen 12 in the position of use and are engagable in the recesses 36 to releasably lock the marker pen in the stored position.

The inner end portion 16 of the marker pen 12 extends at an obtuse angle to the outer end portion 18. The inner end portion 16 extends in straight-line continuation of the arm 30 and coincides with a central axis of the arm when the marker pen is in the position of use.

When using the marker pen 12 to write or mark on a surface, the marker pen will be pivoted to the FIG. 1 position of use and be releasably locked in such position by the detents 34 engaging in the recesses 38. The marker pen will usually be held in the hand of the user with the support arm 30 resting in the hand between a thumb 40 and an index finger 42 and with the marker tip 20 extending forwardly for marking. In this position, and even when marking or writing on a vertical surface, the outer end portion 18 of the marker pen 12 extends upwardly from the arm in a position such that the reservoir 24 is above the marker tip 20. This ensures that marker fluid will flow from the reservoir 24 to the marker tip 20 by gravity so that there will at all times be a continuous flow of marker fluid to the marker tip. This will be true whether the marker pen is used to write on a horizontal surface of even on a vertical surface.

Figure 2:
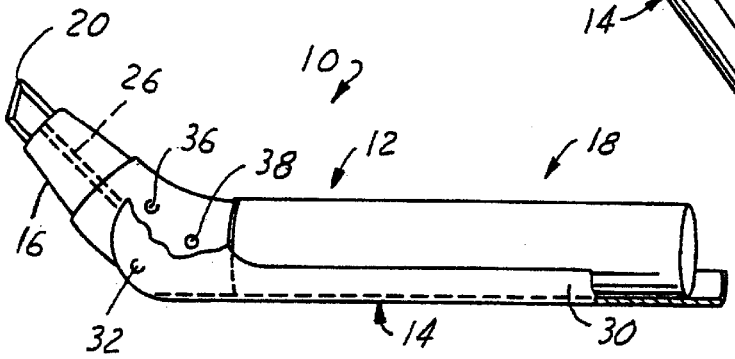
FIG. 2 is a view similar to FIG. 1 but showing the pen in a stored position relative to the support arm.
Figure 4:
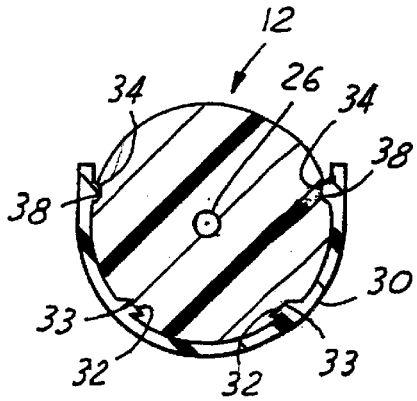
FIG. 4 is a sectional view taken on the line 4—4 in FIG. 1.
Figure 3:
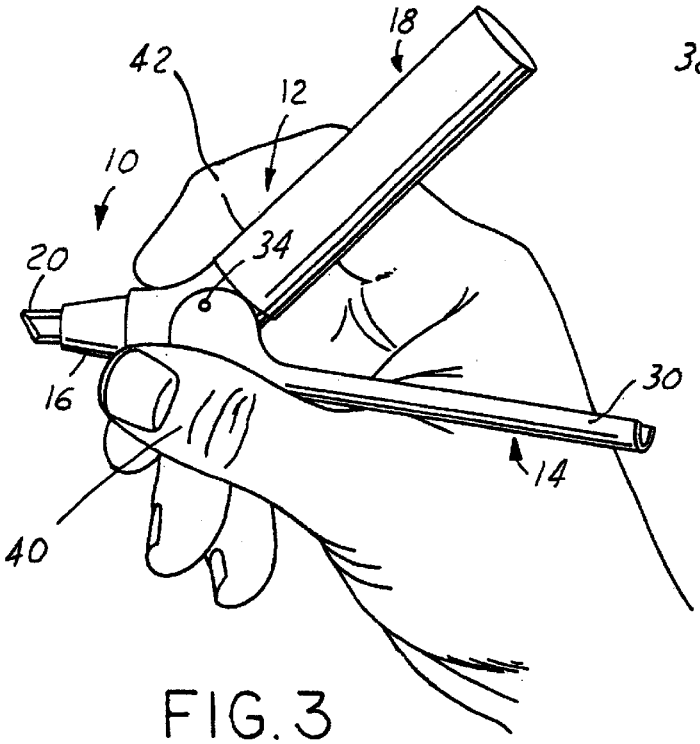
FIG. 3 is a perspective view showing the pen in the hand of a user in a position for marking on a vertical surface.

In its stored position when not in use, the outer end portion 18 of the marker pen 12 extends alongside the arm 30 in parallel relationship thereto as in FIG. 2, and will be releasably locked in such position by the detents 34 engaging in the recesses 36.

Only a small amount of pressure is required to cause the detents 34 to disengage the recesses 36 or 38 when pivoting the marker pen from one position to the other. Somewhat more pressure is required to flex the arm 30 sufficiently to disengage to pivots 32 from the sockets 33 and thereby separate the marker pen 12 from the arm 30. There would be little if any reason to separate the marker pen 12 from the arm 30 except for replacement or repair of one of these parts.

What is claimed is:

1. A marker pen assembly comprising an elongated pen member having an inner end portion provided with a marker tip on a free end of said inner end portion, said pen member having an elongated barrel-shaped outer end portion defining a chamber providing a reservoir for marker fluid, said pen member having passage means for conducting a flow of the marker fluid from the reservoir to the marker tip, an elongated support arm member for the pen member, pivot means connecting the pen member to one end of the support arm member at a point between the inner and outer end portions of the pen member for pivotal movement of the pen member from a first position of use to a second position for storage, and means for releasably locking said pen member selectively in said first position and in said second position, said outer end portion of the pen member extending alongside the arm member in parallel relationship to the arm member when said pen member is in the second position for storage, the outer end portion of the pen member extending upwardly from the support arm member in a position such that the reservoir is above the marker tip when the pen member is in the first position of use and the marker pen assembly is held in a hand of a user with the support arm member resting in the hand between a thumb and an index finger of the hand and the marker tip extends forwardly for marking, said means for releasably locking said pen member comprising a detent carried by one of said members and recesses in the other of said members selectively engaged by said detent in the respective first and second positions of said pen member, wherein the inner end portion of the pen member is disposed at an obtuse angle to the outer end portion of the pen member, and the inner end portion of the pen member extends in straight line continuation of the arm member and coincides with a central axis of said arm member when the pen member is in the first position of use.

2. The marker pen of claim 1, wherein said arm member is in the form of a concavo-convex, semi-cylindrical trough and in the second position for storage the outer end portion of said pen member rests in said trough.

* * * * *